United States Patent [19]

Rosenheck

[11] 3,947,968

[45] Apr. 6, 1976

[54] DEVICE FOR DRAWING ELLIPSES

[76] Inventor: Danny Rosenheck, 26 Brodetski St., Tel Aviv, Israel

[22] Filed: Apr. 28, 1975

[21] Appl. No.: 572,177

[30] Foreign Application Priority Data

June 3, 1974 Israel ..... 44953

[52] U.S. Cl. ..... 33/30 E

[51] Int. Cl.[2] ..... B43L 11/04

[58] Field of Search ..... 33/30 E

[56] References Cited

UNITED STATES PATENTS

| | | | |
|---|---|---|---|
| 149,474 | 4/1874 | Hazen | 33/30 E |
| 707,580 | 8/1902 | Gregory | 33/30 E |
| 768,997 | 8/1904 | Johnson | 33/30 E |
| 1,488,641 | 4/1924 | Johnston | 33/30 E |
| 3,224,098 | 12/1965 | Terrell | 33/30 E |

*Primary Examiner*—Richard E. Aegerter
*Assistant Examiner*—Charles E. Phillips
*Attorney, Agent, or Firm*—Benjamin J. Barish

[57] ABSTRACT

A device for drawing ellipses comprises a measuring stick formed with a longitudunal slot closed at its ends, a cord having one end fixed to a first point on the measuring stick, a slide movable along the slot to align the indexing point thereof with a second point on the measuring stick, and releasable cord fixing means at the indexing point of a lower section of the slide for fixing a predetermined length of the cord between the slide indexing point and the first-mentioned point of the measuring stick. The first and second points of the measuring stick thus constitute the two focii of the ellipse to be drawn, and the mentioned predetermined length of cord is thus equal to the sum of the distances from the two focii to all points on the ellipse to be drawn.

8 Claims, 6 Drawing Figures

DEVICE FOR DRAWING ELLIPSES

BACKGROUND OF THE INVENTION

The present invention relates to devices for drawing ellipses, such devices being sometimes called ellipsographs.

A number of such devices are known but have not yet found widespread use primarily because of their complicated and expensive construction and/or the inconvenience in their use.

An object of the present invention is to provide a device of this type which is simple in construction, inexpensive to produce particularly on a mass production basis, and simple to use in drawing ellipses.

SUMMARY OF THE INVENTION

According to the present invention, there is provided a device for drawing ellipses comprising a measuring stick having an upper face carrying graduated markings and a lower face restable on a flat surface on which the ellipse is to be drawn. The measuring stick is formed with a longitudinal slot extending the length thereof and closed at its ends. One end of a cord is fixed to a first point on the measuring stick, and the slide is movable along the slot to align an indexing point thereof with a second point on the measuring stick. The slide includes an upper section overlying the upper face of the measuring stick and a lower section underlying the lower face of the measuring stick, the two sections being connected to each other by a connection passing through said slot. The device further includes releasable cord fixing means at the indexing point of the lower section of the slide for fixing a predetermined length of the cord between the slide indexing point and the first point of the measuring stick. The first and second points of the measuring stick constitute the two focii of the ellipse to be drawn, the predetermined length of cord being equal to the sum of the distances from said focii to all points on the ellipse to be drawn.

In this described embodiment, the lower section of the slide is formed with a first bore extending transversely of the slide through which the cord passes, and with a second bore communicating with and at right angles to the first bore in the direction of the thickness of the slide, the upper section of the slide being formed with a pin passing through the slot of the measuring stick into said second bore and releasably engageable with the cord therein for fixing same to the slide.

According to a further feature of the invention, the cord carries a guiding element for the marking implement drawing the ellipse, the guiding element being freely movable along the cord and including a member vertically spaced from the drawing surface and formed with an opening for receiving the marking implement.

In the described embodiment, this guiding element member is formed at one end in a U-shaped section and includes a pin passing through the legs of the "U" parallel to and spaced from the base of the U, the opposite end of the member being formed with said opening for receiving the marking implement and being spaced from the drawing surface by one of said legs.

A device constructed in accordance with the foregoing features of the invention may be produced at low cost on a mass production basis from plastic and may be used in a very simple and convenient manner for drawing ellipses.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
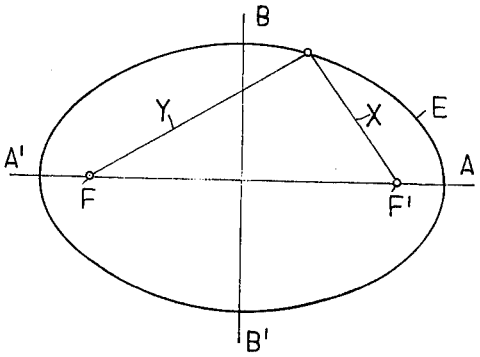
FIG. 1 illustrates an ellipse drawn by the use of the device of the present invention.
Figure 2:
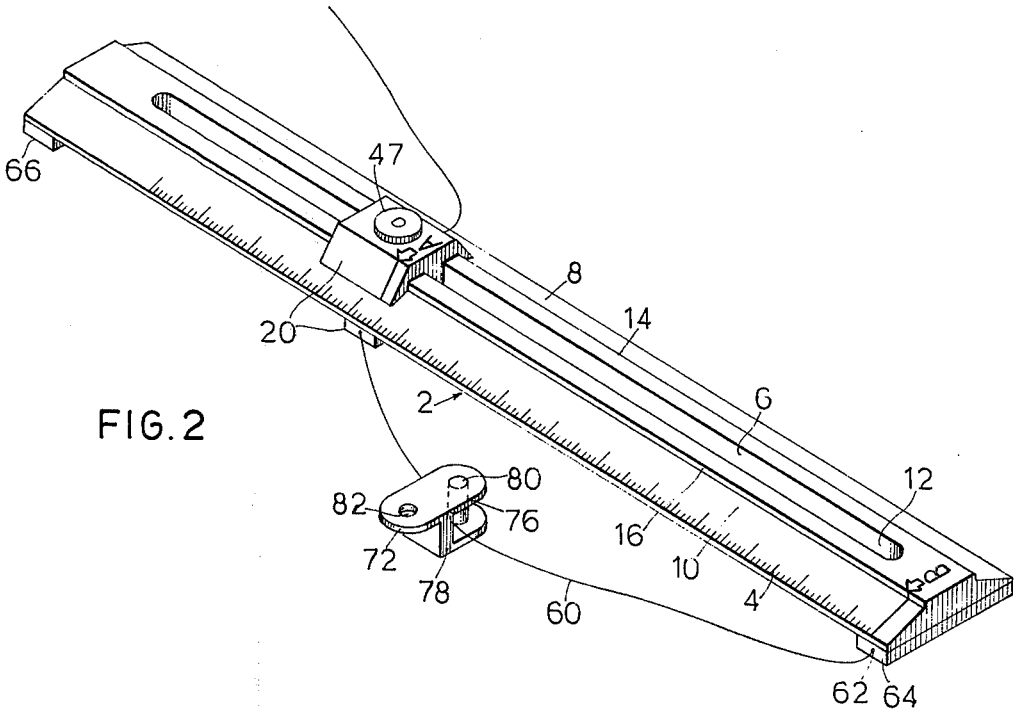
FIG. 2 is a perspective view of one form of device constructed in accordance with the invention.
Figure 3A:
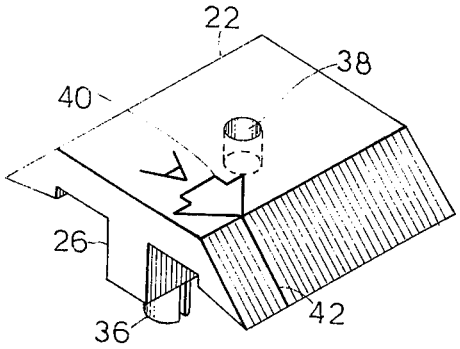
FIGS. 3*a* and 3*b* are top and bottom perspective views, respectively, of the upper section of the movable slide in the device of FIG. 2.
Figure 3B:
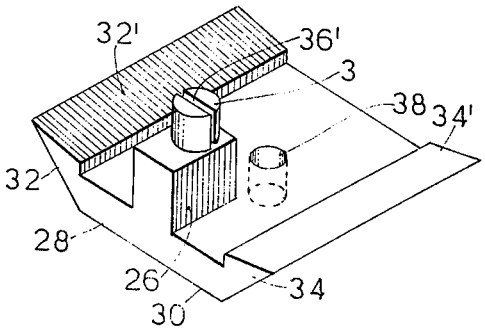

Reference is first made to the ellipse illustrated in FIG. 1 As known, an ellipse is a plain curve formed by the locus of the point which moves so that the sum of its distances from two fixed points (called the focii) is constant. In the ellipse E illustrated in FIG. 1, the two focii are shown at points F, F′, respectively. The major axis of the ellipse is indicated by line A—A′, and the minor axis of the ellipse is indicated by the line B—B′. Line X represents the distance from focus F to any point on the ellipse E, and line Y represents the distance from focus F′ to the same point on the ellipse. As indicated above, the sum of the distances X and Y will always be the same for all points on the ellipse.

FIGS. 2–5 illustrate a device constructed in accordance with my invention that may be used for conveniently drawing the ellipse of FIG. 1.

This device comprises a measuring stick, generally designated 2, the upper face of which carries graduated markings 4 (graduated in distance), and the lower face of which is restable on a flat surface on which the ellipse is to be drawn, e.g., a sheet of paper resting on a flat table. The measuring stick is formed with a longitudinal slot 6 extending along the length thereof, the slot being closed at its ends.

The outer margins, 8, 10, of the upper face of the measuring stick 2 are of increasing thickness, from the outer edges towards the centre. These margins are joined with a centre strip 12 of uniform thickness, which strip is raised from margins 8, 10 as shown by shoulders 14, 16. The graduated markings 4 are formed on one or both margins 8, 10 of the measuring stick, and the longitudinal slot 6 is formed on the raised centre strip 12.

Figure 4:
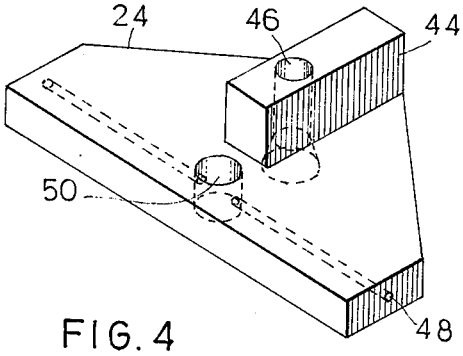
FIG. 4 is a perspective view of the lower section of the slide in the device of FIG. 2.

The device further includes a slide, generally designated 20, passing through and movable along slot 6 of the measuring stick. Slide 20 is constituted of two sections, namely an upper section 22(FIGS. 3*a*, and 3*b*) and a lower section 24 (FIG. 4).

Upper section 22 of the slide is of substantially rectangular shape and includes a ridge or pin 26 depending from its lower surface and passing through slot 6 of the measuring stick. On each side of ridge 26, there is formed a flat wall 28, 30, which walls overlie the raised central strip 12 of the measuring stick. Each wall terminates in a depending ledge 32, 34 overlying a portion of the tapered margins 8, 10 of the measuring stick. The end faces 32′, 34′ on ledges 32, 34 are tapered to conform to margins 8, 10.

In addition, ridge 26 is formed with a depending pin or embossment 36 notched at its end face as shown at 36′. Further, an opening 38 is formed through slide section 22 centrally thereof and laterally of ridge 26.

The upper face of slide section 22 (FIG. 3*a*) is marked with an arrow 40, the top of which is in alignment with a line 42 constitute an indexing point on the slide which is alignable with the graduated markings 4 formed on the measuring stick.

The lower section 24 (FIG. 4) of the slide is of generally triangular shape and includes a ridge 44 adapted to pass through slot 6 of the measuring stick and alignable with ridge 26 of the upper section 22. Ridge 44 is formed with an opening 46 alignable with opening 38 of the upper section 22, a screw 47 (FIG. 2) passing through the two openings. Further, lower section 24 includes a bore 48 extending transversely of the section in alignment with index line 42. Section 24 is formed with a second bore 50 communicating with and of larger diameter than bore 48 and at right angles thereto. Bore 50 is aligned with pin 36 of the upper section 22.

The drawing device further includes a flexible cord 60, one end of which is fixed to one end 62 of the measuring stick. The lower face of the measuring stick carries a foot 64, 66 at each end for raising the stick slightly from the table, a distance equal to or slightly larger than the thickness of the lower slide section 24.

The opposite end of cord 60 is passed through bore 48 in the lower slide section 24, and is fixed by means of pin 36 of the upper slide section 22 passing through bore 50 and gripping the cord.

Thus, a predetermined length of the cord between point 62 of the measuring stick and indexing point 42 of the slide may be provided by loosening screw 47, to release cord 60 from engagement with pin 36, adjusting the predetermined length of the cord, and then re-tightening screw 47 to cause the cord in notch 36′ of pin 36 to be gripped between the sides of the pin.

Figure 5:
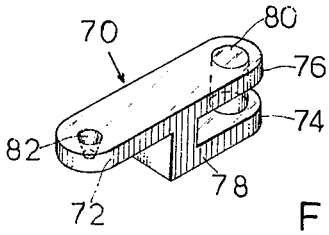
FIG. 5 is a perspective view of the guiding element in the device of FIG. 2; which element is used for guiding the marking implement drawing the ellipse.

Cord 60 carries a guiding element, generally designated 70 (FIG. 5), for the marking implement drawing the ellipse. As shown in FIG. 5, guiding element 70 includes a flat member or strip 72 formed at one end in a U-shaped section, the legs of which are indicated at 74 and 76, and the base of which is indicated at 78. A pin 80 passes through legs 74 and 76 parallel to and spaced from the base 78. The opposite end of member 72 is formed with an opening 82 for receiving the marking implement. As seen in FIG. 5, the end of member 72 formed with opening 82 is spaced from the drawing surface by leg 74, which thereby permits the guiding element to be used with liquid-ink marking implements.

In using the device illustrated for drawing an ellipse, slide 20 is first moved to the appropriate position along the measuring stick 2 wherein the distance between point 62 (the point to which the end of cord 60 is attached) and indexing line 42 of the slide is equal to the distance between the two focii of the ellipse to be drawn, it being appreciated that point 62 constitutes one focus of the ellipse, and line 42 constitutes the other focus. Cord 60 is adjusted within bore 48 of the lower slide section 24 to provide a predetermined length of cord equal to the sum of the distances from the two focii to all points on the ellipse to be drawn. Screw 47 is tightened, and the marking implement is then inserted within opening 82 of guide 70 and is moved 180° to draw one half of the ellipse. The measuring stick is turned round and the process is repeated to draw the second half of the ellipse. When actually drawing the ellipse, the marking implement is pressed outwardly on the cord so as to always keep the cord taut.

In order to adjust cord 60, screw 47 is loosened, and also finger-pressure is applied downwardly on the screw. This causes pin 36 to pop-outwardly of bore 50, which thereby releases cord 60. An important advantage in the construction illustrated is that merely loosening screw 47 (which can ocurr accidently) will not release pin 36 and the cord 60 (since the pin is held within bore 50 by friction), but screw 47 must also be pressed downwardly to move pin 36 outwardly of its bore 57 and thereby to release the cord. To re-fix the cord, finger-pressure is applied to the upper slide section 22 over pin 36, forcing the latter into bore 50 to thereby engage the cord, and screw 47 is then tightened. This arrangement also reduces the friction on the cord, and thereby wear, during frequent resetting of the cord for drawing different size ellipses.

What is claimed is:

1. A device for drawing ellipses, comprising: a measuring stick having an upper face carrying graduated markings and a lower face restable on a flat surface on which the ellipse is to be drawn, the measuring stick being formed with a longitudinal slot extending the length thereof and closed at its ends, a cord having one end fixed to a first point on the measuring stick, a slide movable along the slot to align an indexing point thereof with a second point on the measuring stick, said slide including an upper section overlying the upper face of the measuring stick and a lower section underlying the lower face of the measuring stick, the two sections being connected to each other by a connection passing through said slot, said lower section of the slide being formed with a first bore aligned with said indexing point and extending transversely of the slide through which bore the cord passes, and with a second bore communicating with and at right angles to the first bore in the direction of the thickness of the slide, said upper section of the slide being formed with a pin passing through the slot of the measuring stick into said second bore and releasably engagable with the cord therein for fixing a predetermined length of the cord between the slide indexing point and the first point of the measuring stick, said first and second points of the measuring stick constituting the two focii of the ellipse to be drawn, and said predetermined length of cord being equal to the sum of the distances from said focii to all points on the ellipse to be drawn.

2. A device according to claim 1, wherein said connection comprises a threaded fastener passing through both slide sections for drawing them together and for releasably fixing the cord to the slide lower section.

3. A device according to claim 1 wherein the end face of the upper section pin is formed with a notch for securely gripping the cord.

4. A device to claim 1, wherein said cord carries a guiding element for the marking implement drawing the ellipse, said guiding element being freely movable along the cord and including a member vertically spaced from the drawing surface and formed with an opening for receiving the marking implement.

5. A device according to claim 5, wherein said member is formed at one end in a U-shaped section and includes a pin passing through the legs of the U parallel to and spaced from the base of the U, the opposite end of the member being formed with said opening for receiving the marking implement and being spaced from the drawing surface by one of said legs.

6. A device according to claim 1, wherein said slide first section is substantially rectangular in shape, and said slide second section is substantially triangular in shape.

7. A device according to claim 1, wherein the upper face of the marking stick is formed with margins of increasing thickness from the outer edges towards the center, the measuring stick further including a raised central strip of increased thickness in which strip the longitudinal slot is formed.

8. A device according to claim 1, wherein the lower face of the marking stick is provided with a foot of each end for raising same a distance at least equal to the thickness of the lower slide section.

* * * * *